United States Patent [19]

Mark et al.

[11] 3,974,923

[45] Aug. 17, 1976

[54] TILTING RAMP ASSEMBLY FOR FISHING VESSELS

[76] Inventors: Viggo Mark, 1401 - 1460 Barclay, Vancouver, British Columbia; Matthew John Sikich, 3171 Westmount Place, West Vancouver, British Columbia, both of Canada

[22] Filed: Sept. 16, 1974

[21] Appl. No.: 506,334

[52] U.S. Cl. ..... 214/15 R; 43/8

[51] Int. Cl.[2] ..... B63B 27/00

[58] Field of Search ..... 214/15 R, 12, 505, 1 A; 114/.5 A; 9/41; 43/8; 193/17–21

[56] References Cited

UNITED STATES PATENTS

| | | | |
|---|---|---|---|
| 268,608 | 12/1882 | Bentley | 193/17 X |
| 3,006,097 | 10/1961 | Luketa | 43/8 |
| 3,047,973 | 8/1962 | Puretic | 43/8 |
| 3,227,292 | 1/1966 | Jacobs | 214/1 A |
| 3,303,945 | 2/1967 | Hubbard et al. | 214/15 R |
| 3,465,901 | 9/1969 | Grabowski | 214/1 SR |

*Primary Examiner*—Frank E. Werner

*Attorney, Agent, or Firm*—Carver and Company

[57] ABSTRACT

Tilting ramp assembly for fitting to fishing vessel for assisting in raising fishing nets, and launching and recovery of small boats. Assembly has fixed portion secured adjacent the stern of the vessel and moving portion hinged thereto with roller journalled at outer end. Hydraulic cylinder extends between fixed and moving portions for swinging the portions between raised and lowered positions. Spooling gear mounted on ramp assembly feeds rope smoothly onto winch and has spool guides which are removeable when the net is drawn up the ramp, and also serve as skiff guides when hauling skiff up ramp. When raising the net, ramp moves simultaneously from lowered position to raised positon as net swings upwards, reducing crushing of fish.

10 Claims, 10 Drawing Figures

TILTING RAMP ASSEMBLY FOR FISHING VESSELS

BACKGROUND OF THE INVENTION

1. Field Of The Invention

The invention relates to a tilting ramp assembly for a fishing vessel, the assembly being used for assisting in raising fishing nets and also launching and recovery of smaller boats, such as skiffs.

2. Prior Art

Stern trawlers and seiners commonly haul a catch of fish over the stern of the fishing vessel. The stern is provided with a roller to reduce friction as the heavy net, loaded with fish, is hauled aboard, often with the help of additional lines running from suspended blocks. In both methods of fishing, a portion of the catch is lost due to damage resulting from the weight of the fish in the net crushing those fish passing close to the roller. Sometimes as much as a fifth of the catch is lost from such damage.

Also, with seining a small boat or skiff is required for setting the net in the required path prior to hauling in. Commonly such boats are hauled aboard by davits or derrick means and in heavy swells this can be troublesome. Some fishermen prefer to haul the boat over the stern ramp, however, it is difficult to attach lines to the boat for efficient hauling. With the present devices known to the inventors hauling the boat aboard can be a time consuming and sometimes hazardous process.

SUMMARY OF THE INVENTION

The invention reduces difficulties of the prior art by providing a tilting ramp assembly which is used to assist in raising the loaded net to reduce damage to the catch, and also can be used for launching or hauling aboard a skiff or other small vessel. The ramp assembly is adapted for fitting to a fishing vessel, usually at the stern thereof, and is used in combination with a winch for hauling in trawl or seine nets.

The ramp assembly has a fixed portion secured to the vessel, and a moving portion hinged to the fixed portion for swinging thereabouts between raised and lowered positions, the moving portion having an outer end having a rolling means. Powered means cooperate with the fixed and moving portions to swing the moving portion between the raised and lowered positions. In one embodiment in which the fishing vessel has a central longitudinal axis and a transom at the stern thereof, the ramp is adapted for attachment adjacent to the transom. The fixed portion has a first hinge portion and the moving portion has a second hinge portion complementary to the first hinge portion. A hinge having a hinge axis is formed by the hinge portions, the hinge axis being disposed normally to the longitudinal axis of the vessel, and disposed horizontally when the vessel floats without list.

A detailed disclosure following, related to drawings, describes a preferred embodiment of the invention, which however is capable of expression in structure other than that particular described and illustrated.

DESCRIPTION OF THE DRAWINGS

FIG. 1

Figure 1:
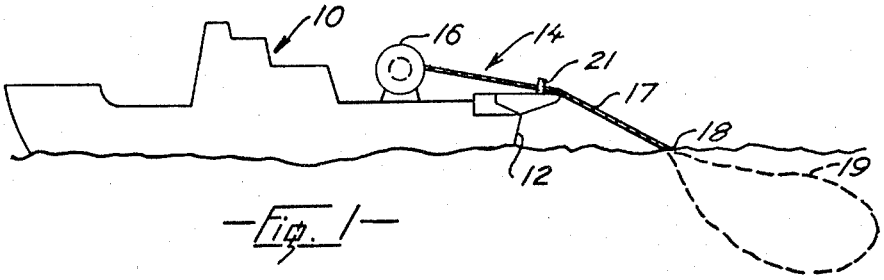
FIG. 1 is a side elevation of the fishing vessel fitted with a ramp assembly of the invention, the ramp being shown in a raised position.

A fishing vessel 10 has a transom 12 at the stern thereof, and a tilting ramp assembly 14 according to the invention secured adjacent the transom. A powered winch 16 is fitted forward of the ramp 14, and a rope 17 wound on a reel of the winch is connected at an outer end thereof to a forward end 18 of a net 19. Spooling gear 21 cooperates with the ramp, the rope 17 passing therethrough so as to be wound evenly on the winch. The net 19 can be any type of fishing net in which fish are contained within a bag formed by the net, for instance a trawling net or purse seine type of net.

FIGS. 2 Through 5

The ramp 14 includes a fixed portion 25 secured to the vessel, and a moving portion 27 hinged by a hinge 28 to the fixed portion. The hinge has a hinge axis 29 and the portion 27 can swing about the hinge axis between raised and lowered positions shown in FIGS. 3 and 5 respectively. The hinge axis 29 is disposed normally to a longitudinal axis 30 of the vessel, the hinge axis being disposed horizontally when viewed along the axis 30 with the vessel floating without list. The fixed portion 25 includes a pair of spaced parallel fixtures 31 and 32 adapted to be secured adjacent gunwales 33 and 34 of the vessel 10. The fixture 32 has a bracket 37 extending aft therefrom, the bracket having a bore concentric with the hinge axis 29. A similar bracket 38, shown in broken outline in FIG. 3, extends from the fixture 35. The brackets 37 and 38 have aligned bores concentric with the hinge axis to serve as the first hinge portion. The moving portion includes a ramp platform 39 having inner and outer ends 41 and 42 respectively. The ramp platform includes a pair of spaced arms 45 and 46 disposed parallel to the axis 30 and at the opposite sides of the platform, the arms extending between the inner and outer ends of the platform. The arm 46 has a pair of spaced sidewalls which carry a hinge pin 48 which is accepted in the bore of the bracket 37 to form a portion of the hinge 28. The arm 45 has a similar pin 49 accepted in the bracket 38, the two pins serving as bearing means of the second hinge portion complementary to the first hinge portion.

The moving portion 27 has a first cylindrical roller 53 extending between the outer ends of the arms 45 and 46, and adjacent to the outer end 42 of the ramp platform. The roller extends normally between the outer ends of the arms and is journalled for rotation about a central axis 54 thereof. The ramp assembly further includes a second cylindrical roller 56 journalled for rotation about a central axis 57 thereof and extending normally between the arms and disposed parallel to the roller 53. The second roller is disposed on a side of the hinge axis 29 remote from the first cylindrical roller and towards the inner end 41 of the ramp platform. The ends of the ramp platform are relatively unrestricted to facilitate passage of items along the ramp platform.

Figure 2:
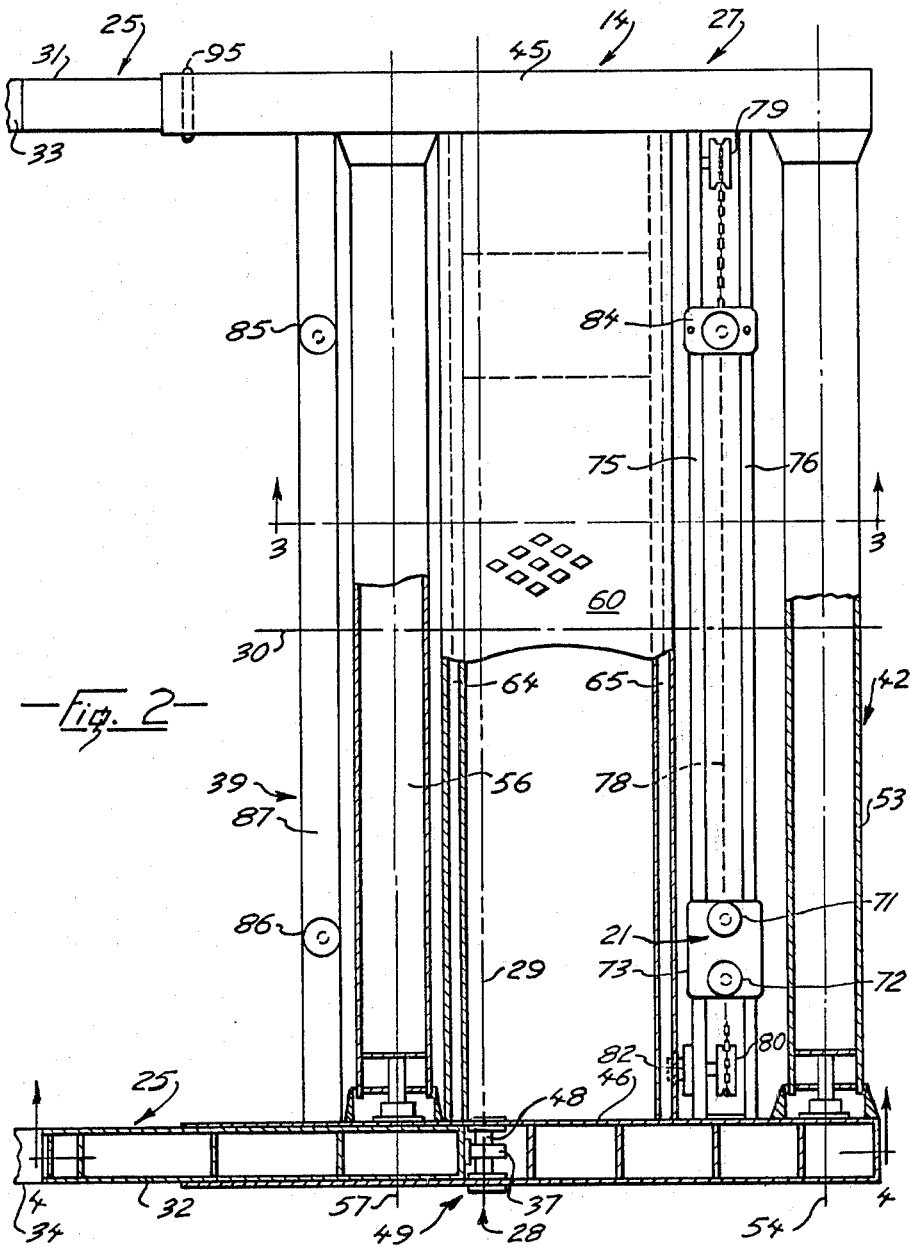
FIG. 2 is a top plan of the ramp according to the invention, some portions being omitted, the ramp being shown in a raised position.
Figure 3:
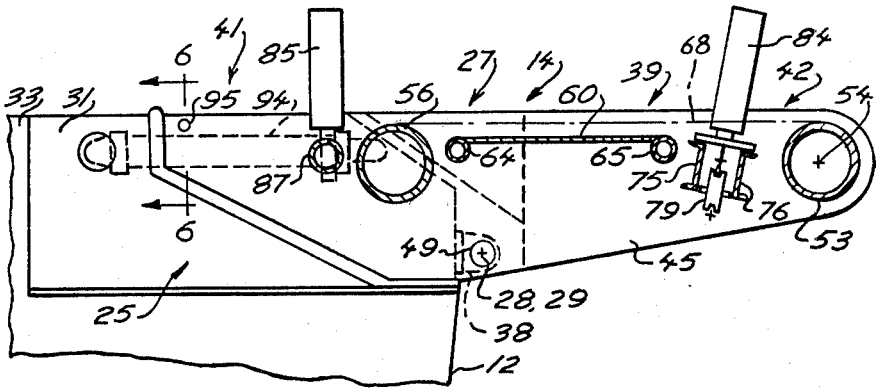
FIG. 3 is a simplified fragmented section on 3—3 of FIG. 2, portions of the vessel being shown.
Figure 4:
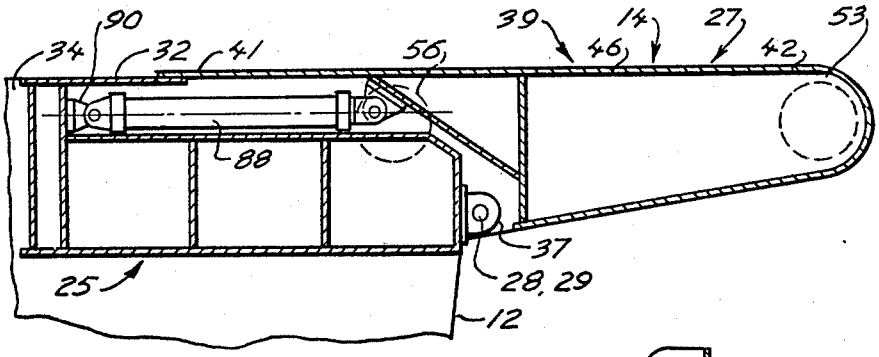
FIG. 4 is a simplified fragmented section on 4—4 of FIG. 2, portions of the vessel being shown.

A perforated web 60 extends transversely between the arms 45 and 46 and is supported at outer edges thereof on a pair of spaced stiffening tubes 64 and 65. As seen in FIG. 3, the hinge axis 29 and the web 60 are disposed below a common tangent 68 of upper surfaces of the rollers. This ensures that items on the platform are clear of the hinge and that drag of items on web is reduced. The spooling gear 21 is positioned between the first and second rollers and aft of the web 60, and has a pair of spaced sheaves or rollers 71 and 72 journalled on parallel pins extending from a carriage 73. The sheaves are spread sufficiently to permit the rope 17 to pass freely therebetween The carriage is supported on a pair of spaced parallel rails 75 and 76 extending normally between the arms, and thus is mounted for sliding transversely across the ramp. An endless chain 78 extends between sprockets 79 and 80 provided at opposite ends of the rails, the chain being connected to the carriage 73 by means not shown. A hydraulic motor 82 powers the sprocket 80 and is controlled so as to reverse direction of rotation of the sprocket 80 as the carriage 73 approaches either end of the rail. Thus the carriage 73 is adapted to reciprocate between the arms, so that when the rope 17 passes therethrough the cable is fed evenly onto the reel of the winch 16 (FIG. 1). The sheaves 71 and 72 are detachable from the carriage so that the net can pass up the ramp, as will be described, without interference from the spooling gear. When loading a skiff, one sheave only need be detached, that is a particular sheave, e.g. the sheave 71, nearest the center of the ramp platform when the carriage if adjacent an end of the rails. The sheave 72 remaining on the carriage assists in guiding the skiff up the ramp as will be described. A further skiff guide roller 84 is releasably attached manually to the rails 75 and 76 by means not shown. The roller 84 cooperates with the sheave 72 and can be positioned manually relative to the sheave 72 to suit skiff width. Thus one sheave of the spooling gear also serves as a skiff roller to ensure desired tracking of the skiff relative to the ramp as the skiff is hauled up or lowered down the ramp. With reference to FIGS. 2 and 3, two additional skiff guides 85 and 86 extend upwards from a supporting rail 87 extending between the arms 45 and 46. The skiff guides 85 and 86 are used only when hauling in the skiff and are removeable manually from the rail to permit passage of the net. Spacing between the guides 85 and 86 is similarly adjustable to accommodate skiffs of different widths.

Figure 5:
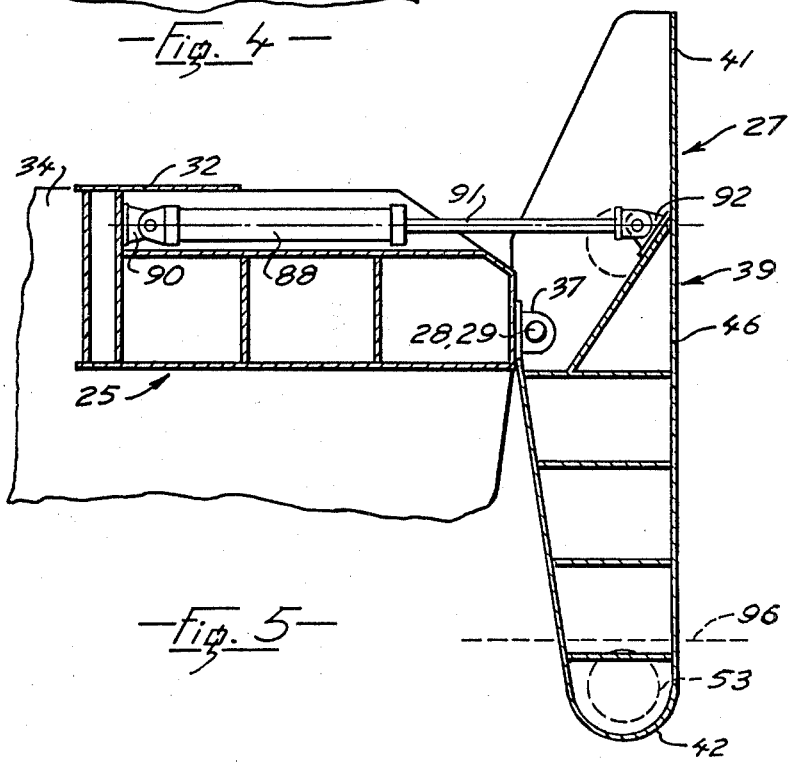
FIG. 5 is a simplified fragmented section taken in a plane similar to 4—4 of FIG. 2, the ramp being shown in a fully lowered position.

An extensible and retractable hydraulic cylinder 88 extends between the fixed and moving portions and serves as a powered means cooperating with the portions to swing the moving portion between the raised and lowered positions. The cylinder 88 is disposed parallel to the axis 30 and is hinged at a forward end thereof to a cylinder mounting means 90 secured to the fixture 32. The cylinder has a ram 91 hinged at an outer end thereof to a ram mounting means 92 secured to the arm 46. A similar cylinder 94, shown in broken outline in FIG. 3 only, cooperates with the arm 45 and the fixture 31 and is disposed parallel to the cylinder 88 and functions similarly. Thus, when the rams are retracted the ramp platform 39 extends horizontally as shown in FIGS. 1 through 4, and when the cylinder is actuated and the ran extends, the ramp platform swings to the lowered position shown in FIG. 5. The cylinders are disposed so that extension of the cylinders from a fully retracted to a fully extended position swings the ramp platform through approximately 90°. Each cylinder is positioned so that extreme inner and outer positions of the outer end of the ram are disposed approximately symmetrically on either side of the hinge axis. As seen in FIG. 5, when the ramp platform is fully lowered the roller 53 is preferably below the surface of the water, shown as a broken line 96.

A releaseable locking pin 95 cooperates with undesignated aligned openings in the fixed and moving portions to prevent relative movement therebetwween when the ramp platform is in the raised position. The pin is removed when the ramp platform is to be lowered and this is described in greater detail with reference to FIG. 6. The cylinders 88 and 94 are examples of powered means for swinging the platform 39 - equivalents can be substituted. Other extensible and retractable devices having fore and aft portions can be fitted so as to be disposed parallel to the longitudinal axis.

FIG. 6

Figure 6:
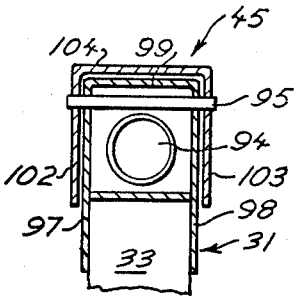
FIG. 6 is a simplified fragmented section at enlarged scale on 6—6 of FIG. 3, some portions being omitted.

The fixture 31 has spaced parallel inner and outer side walls 97 and 98 and a top wall 99 extending between the side walls, the walls being formed of sheet material and enclosing the gunwale 33 adjacent the transom. The inner end of the arm 45 has spaced parallel inner and outer side walls 102 and 103 and a top wall 104 extending between the side walls. The walls of the arm 45 are spaced from the walls of the fixture 31 sufficiently to permit the arm to swing smoothly into position over the fixture when the ramp platform is raised, as shown in FIG. 6. The side walls 97, 98, 102 and 103 have the undesignated aligned openings to accept the locking pin 95 when the ramp platform is raised as shown. Locking means (not shown) hold the pin in position to prevent accidental withdrawal and the pin prevents slow downwards creeping of the ramp. The pin is withdrawn manually to permit the ramp platform to be swung downwards, and reinserted in the openings when the ramp platform is raised.

As can be seen also with reference to FIG. 3, when the ramp platform is raised the cylinder 84 is substantially completely enclosed by side and top walls of the fixture 31 and forward portions of the arm 45. The cylinder 88 is similarly protected by the fixture 32 and the arm 45. Thus, when the ramp is raised and not in use, the cylinders are protected from impact damage, and to a certain extent from weathering. Further, when the ramp platform is raised the assembly 14 presents a relatively smooth and clean appearance, thus reducing a tendency to foul and possibly tear the net. This has advantages in the harsh environment of commercial sea fishing. Also the cylinder is easily accessible for servicing by extending the ram to lower the ramp platform, in which position the cylinder can be readily repaired or replaced.

OPERATION

FIGS. 1, 7 Through 9

Figure 7:
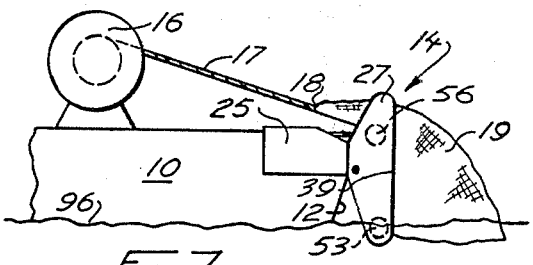
FIG. 7 is a fragmented diagram of a vessel recovering a net, the net and ramp being shown in an initial position.

In FIG. 1 the vessel is shown trawling as a stern trawler and hauling in the net 19 secured to the rope 17. As the rope 17 is wound in on the winch 16, the spooling gear 21 reciprocates across the ramp platform feeding the rope evenly onto the winch. Just before the forward end 18 of the net contacts the roller 53, the sheaves 17 and 72 of the spooling gear 21 (FIG. 2) are removed to provide clearance for the net to pass freely over the carriage 73 of the spooling gear. The skiff guides 84, 85 and 86 have not been fitted as they are not required when hauling in the net. When the forward end of the net reaches the outer end of the moving portion 27, the ramp is lowered to the fully lowered position, so that the outer end thereof is submerged as shown. The rope 17 is pulled in steadily until the forward end of the net passes over the second rolling means 56, as shown in FIG. 7.

Figure 8:
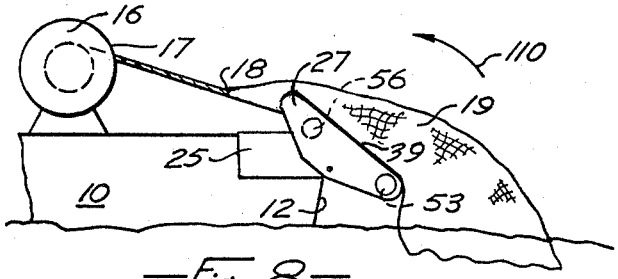
FIG. 8 is a fragmented diagram of the vessel and net of FIG. 7, the net and ramp being shown in an intermediate position.
Figure 9:
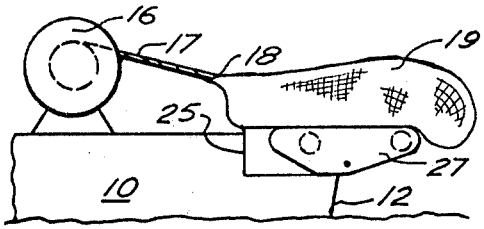
FIG. 9 is a fragmented diagram of the vessel and net of FIG. 7, the net being shown prior to emptying.

With reference to FIG. 8, further taking in of the rope 17 tends to draw the net up the ramp platform and this drawing in is accompanied by simultaneous rotation of the ramp platform 39 in direction of an arrow 110. The platform tends to move under the mass of fish in the net as the platform rotates. Thus the ramp platform assists simultaneously with raising the net, thus reducing relative motion between the net and the ramp platform as the ramp platform swings upwards. The rollers 53 and 56 relieve load from friction on the rope 17 and the net 19 as it passes over the ends of the platform 39. It is noted that positioning the first roller at the outer end of the ramp platform on a side of the hinge axis remote from the second roller permits the first roller to swing below the hinge axis towards or into the water for lifting items clear of the water. In FIG. 9 the net is lifted clear of the water and the moving portion 27 is in the fully raised position, prior to opening of the net for dumping the fish in the hold of the vessel.

Figure 10:
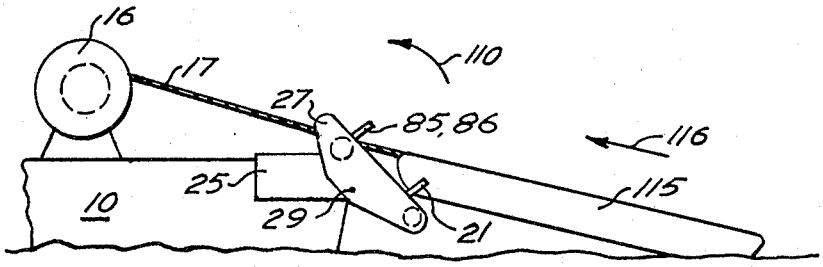
FIG. 10 is a fragmented diagram of the vessel of FIG. 7 recovering a skiff, the skiff and ramp being shown in an intermediate position.

With reference to FIG. 10 a skiff 115 having the bow thereof attached to the rope 17 is to be hauled in the direction of an arrow 116 onto the stern of the vessel 10. Prior to hauling the skiff aboard, the skiff guides 84, 85 and 86 are fitted in position to accommodate the maximum width or beam of the skiff. The carriage 73 of the spooling gear 68 is traversed to the side of the ramp platform opposite to the guide roller 84 and the sheave 71 is removed, so that the remaining sheave 72 serves as a roller guide complementary to the guide 84. The moving portion 27 is held in an intermediate position at approximately 45° degrees and the skiff 115 is hauled across the ramp until the center of gravity of the skiff approaches the hinge axis 29. At this position the ramp is swung in the direction of the arrow 110 so as to position the skiff horizontally on the stern. For a quick and relatively easy launching of the skiff, the reverse procedure is carried out.

We claim:

1. A tilting ramp assembly adapted for fitting to a fishing vessel in which the fishing vessel has a central longitudinal axis and a transom at the stern thereof, the ramp assembly being adapted for attachment adjacent the transom, the ramp assembly having:

a. a fixed portion secured to the vessel, the fixed portion having a first hinge portion including a pair of spaced parallel fixtures adapted to be secured adjacent the transom, each fixture having a bracket extending therefrom, the brackets having aligned bores, b. a moving portion having a second hinge portion complementary to the first hinge portion to form a hinge having a hinge axis concentric with the aligned bores of the fixed portion and disposed normally to the longitudinal axis of the vessel and generally horizontally when the vessel floats without list, so that the moving portion can be swung relative to the fixed portion between raised and lowered positions, the moving portion having a ramp platform with inner and outer ends which are relatively unrestricted to facilitate passage of items along tge ramp platform, the moving portion also including bearing means complementary to the brackets of the first hinge portion to form the hinge and provided adjacent the inner end of the ramp platform, c. first and second rollers provided generally adjacent the outer and inner ends of the ramp platform, each roller being journalled for rotation about a respective central axis thereof disposed parallel to the hinge axis, the first roller being disposed on a side of the hinge axis remote from the second roller so that the first roller can swing below the hinge axis towards the water, d. powered means cooperating with the fixed and moving portions to swing the moving portion between the raised and lowered positions.

2. A tilting ramp assembly as claimed in claim 1 further including:

i. a pair of spaced skiff guides releasably secured to the moving portion adjacent the second cylindrical roller, the spacing between the skiff guides being adjustable to accommodate skiffs of different widths, the skiff guides being removeable for passage of a net along the ramp platform.

3. A tilting ramp assembly as claimed in claim 1 wherein the powered means includes an extensible and retractable hydraulic cylinder extending between the fixed and moving portions.

4. A tilting ramp assembly as claimed in claim 1 in which:

i. the ramp platform includes a pair of spaced parallel arms having inner and outer ends, ii. the first and second rollers are cylindrical and extend normally between the arms and are generally adjacent the outer and inner ends of the arms respectively.

5. A tilting ramp assembly as claimed in claim 4 further including:

i. a spooling gear provided between the first and second cylindrical rollers, the spooling gear having a pair of spaced sheaves and being adapted to reciprocate simultaneously between the arms whilst feeding a rope therethrough.

6. A tilting ramp assembly as claimed in claim 5 in which at least one of the sheaves is detachable to permit passage of a skiff past the spooling gear when the spooling gear is adjacent one arm of the ramp.

7. A tilting ramp assembly as claimed in claim 4 wherein:

i. the powered means is a pair of extensible and retractable devices, each device being disposed parallel to the longitudinal axis and having fore and aft portions, each device being fitted within a respective fixture so that the forward portion of each device is enclosed, ii. the inner end of the arms extend forward and are shaped so as to enclose the aft end of the extensible and retractable device when the ramp is in the raised position, thus protecting to some extent the extensible and retractable device.

8. A tilting ramp assembly as claimed in claim 7 wherein:

i. each device is an extensible and retractable hydraulic cylinder, each hydraulic cylinder having a cylinder mounting means secured to the respective fixture, and a ram having an outer end hinged to the respective arm, each cylinder being disposed so that, in the raised position the cylinder is retracted and the outer end of the ram is forward of the hinge axis, and in a fully extended position the outer end of the ram is aft of the hinge, and the ramp is in the lowered position, so that extension of the cylinder from fully retracted to fully extended positions swings the ramp platform through approximately 90°

9. A tilting ramp assembly as claimed in claim 1 in which:

i. the hinge axis is disposed below a common tangent of upper surfaces of the rollers so that items on the ramp platform are clear of the hinge.

10. A tilting ramp assembly adapted for fitting to a fishing vessel, the ramp assembly having:

a. a fixed portion secured to the vessel, the fixed portion having a first hinge portion, b. a moving portion having a second hinge portion complementary to the first hinge portion to form a hinge having a hinge axis disposed horizontally when the vessel floats without list so that the moving portion can be swung relative to the fixed portion between raised and lowered positions; the moving portion having a ramp platform with inner and outer ends which are relatively unrestricted to facilitate passage of items along the ramp platform, c. first and second rollers provided generally adjacent the outer and inner ends of the ramp platform, each roller being journalled for rotation about a respective central axis thereof disposed parallel to the hinge axis, the first roller being disposed on a side of the hinge axis remote from the second roller so that the first roller can swing below the hinge axis towards the water, d. powered means cooperating with the fixed and moving portions to swing the moving portion between the raised and lowered positions, e. a spooling gear provided between the first and second rollers, the spooling gear having a pair of spaced sheaves and being adapted to reciprocate simultaneously across the ramp platform whilst feeding a rope therethrough.

* * * * *